US007748459B2

(12) United States Patent
Johnson

(10) Patent No.: US 7,748,459 B2
(45) Date of Patent: Jul. 6, 2010

(54) ANNULAR PRESSURE MONITORING DURING HYDRAULIC FRACTURING

(75) Inventor: Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 79 days.

(21) Appl. No.: 11/857,052

(22) Filed: Sep. 18, 2007

(65) Prior Publication Data

US 2009/0071657 A1 Mar. 19, 2009

(51) Int. Cl.
*E21B 33/12* (2006.01)
*E21B 43/26* (2006.01)

(52) U.S. Cl. ..... 166/308.1; 166/188; 166/305.1; 166/183

(58) Field of Classification Search ..... 166/188
See application file for complete search history.

(56) References Cited

U.S. PATENT DOCUMENTS 2,274,756 A * 3/1942 Travers, Jr. ..... 166/129
3,735,813 A * 5/1973 Mack et al. ..... 166/183
4,044,832 A 8/1977 Richard et al.
5,101,913 A 4/1992 Stokley et al.
6,065,535 A * 5/2000 Ross ..... 166/51
6,702,020 B2 3/2004 Zachman et al.
6,776,238 B2 * 8/2004 Dusterhoft et al. ..... 166/308.1
6,837,313 B2 1/2005 Hosie et al.
7,032,666 B2 4/2006 Corbett
7,128,151 B2 10/2006 Corbett
2003/0066650 A1 4/2003 Fontana
2005/0006092 A1 * 1/2005 Turner et al. ..... 166/279

OTHER PUBLICATIONS

Ripa, Giuseppe, et al., "Cost-Effective Sand-Control Operations Play Key Role in Revitalizing a Mature Gas Filed", SPE 99345, SPE Drilling & Completion, Sep. 2005, 209-217.
De Magalhaes, J.V.M, et al., "Gravel-Pack-Placement Limits in Extended Horizontal Offshore Wells", SPE 92428, SPE Drilling & Completion, Sep. 2006, 193-199.
Augustine, Jody, et al., "World's First Gravel-Packed Inflow-Control Completion", SPE 103195, SPE Drilling and Completion, Mar. 2008, 61-67.

* cited by examiner

*Primary Examiner*—Giovanna C Wright
*Assistant Examiner*—Catherine Loikith
(74) *Attorney, Agent, or Firm*—Steve Rosenblatt

(57) ABSTRACT

A pressure or flow responsive valve is provided in a hydraulic fracturing assembly so that if the formation sands out during proppant pumping and pressure in the bypass to the annulus around the work string rises, the bypass is closed by the valve to prevent overpressure of lower pressure rated components further uphole from the formation being treated. These components could be large casing or the blowout preventer assembly.

12 Claims, 1 Drawing Sheet

ANNULAR PRESSURE MONITORING DURING HYDRAULIC FRACTURING

FIELD OF THE INVENTION

The field of the invention is a technique for protecting an annulus leading to the surface from overpressure beyond the limits of tubulars or blowout preventers particularly during a hydraulic fracturing operation.

BACKGROUND OF THE INVENTION

Hydraulic fracturing is performed through a work string that leads from the surface to the desired formation. At some point the work string goes through a seal point and could contain a bypass through that point so that the pressure at the formation can be determined by surface measurements of the annulus pressure that is communicated to the surface through the bypass of the work string that extends through the seal point. The seal point may be a packer or a seal bore. Hydraulic fracturing involves pumping proppant slurry into the wellbore through the work string to the desired formation. The work string terminates above or uphole from the formation being treated. The fluid is forced into the formation to fracture it. The proppant enters the formation to hold open the fissures created from pumping fluid under pressure into the formation to deposit the proppant.

The problem that arises occurs when the formation has what's called a sand out where flow into the formation declines dramatically because the proppant creates a barrier to further fluid progress into the formation. The conditions at the formation during fracturing are normally monitored by checking the annulus pressure at the surface. When the formation sands out the pressure at the formation increases generally because the pumping from the surface is with an engine driven multi-cylinder positive displacement pump. The problem with rising pressure at the formation is that the pressure also rises in the annulus going back to the surface. Going up the annulus there could be larger casing than at the formation that has a lower pressure rating. Alternatively the blowout preventer equipment can also have a lower pressure rating than casing that is closer to the formation being fractured. In those situations, the present invention provides a protection feature to prevent overpressure of these lower pressure rated components. These features and others will be better understood by those skilled in the art from a review of the detailed description and associated drawing that appear below while understanding that the full measure of the invention is found in the appended claims.

SUMMARY OF THE INVENTION

A pressure or flow responsive valve is provided in a hydraulic fracturing assembly so that if the formation sands out during proppant pumping and pressure in the bypass to the annulus around the work string rises, the bypass is closed by the valve to prevent overpressure of lower pressure rated components further uphole from the formation being treated. These components could be large casing or the blowout preventer assembly.

DETAILED DESCRIPTION OF THE PREFERRED EMBODIMENT

Figure 1:
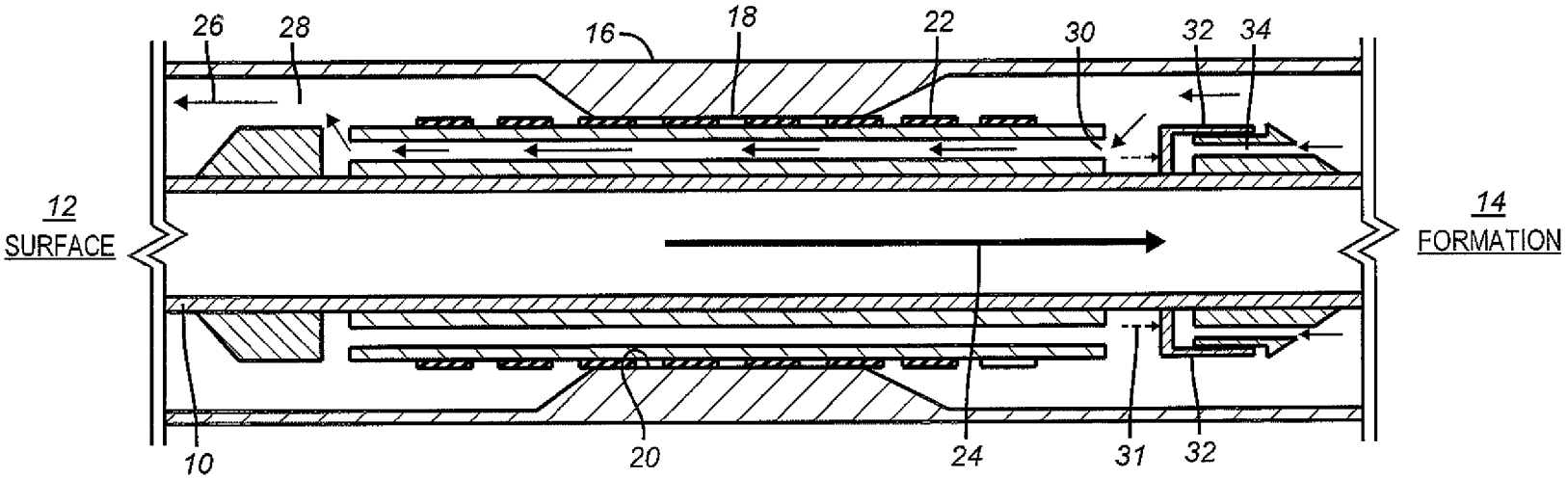
FIG. 1 is a section view in the open position of a hydraulic fracturing assembly with the bypass closure feature of the present invention.

FIG. 1 shows a workstring 10 that extends from the surface 12 to the formation 14 being treated. The wellbore preferably is cased with casing 16 such that comprises at least one seal point such as a packer or a seal bore 18. The workstring 10 has an external bypass 20 that further features one or more exterior seals 22 designed to fit in the seal bore 18. During normal operations, pressure at surface 12 causes flow 24 down to the formation 14. Generally, proppant slurry is used but the formulation being pumped can vary with the makeup of the formation and the compositions being pumped are well known in the art. As the pumping continues fracturing of the formation 14 can occur with some of the solids in the slurry working their way into newly created fissures from the pressures used in delivering the slurry downhole. As a way of monitoring the pressure at the fracture location from the surface, return flow 26 goes through the bypass 20 and up the annular space 28 to the surface 14.

The problem arises when the formation "sands out" or stops taking fluid because the proppant has formed a bridge or has simply filled the newly created fissures which have the effect of blocking flow to the formation 14. When this happens, the pressure at the formation will increase as will the pressure in the bypass 20 and the annular space 28 all the way to the surface 12. The problem can be that the pressure ratings of some of the larger casing going uphole or the blowout preventer assembly can be significantly less than the workstring pressure rating below the seal bore 18. The present invention protects such lower pressure rated equipment automatically when a sand out occurs.

Figure 2:
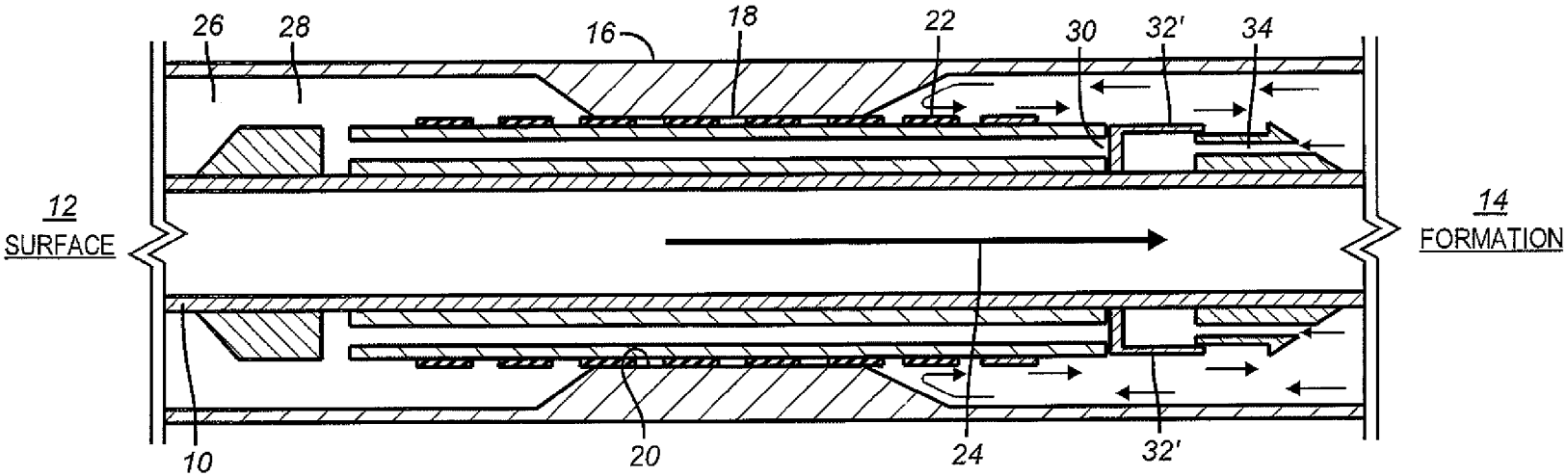
FIG. 2 is the view of FIG. 1 in the closed position.

This protection feature is shown open in FIG. 1 and closed in FIG. 2. Bypass 22 has an inlet 30 and a pressure or flow sensitive valve shown open as 32 and closed as 32'. The valve 32 can work on a variety of principles one of which is to use passages 34 to put a net uphole force on the valve member 32 to close inlet 30. Valve 32 can also work off a localized pressure sensor that operates a motor to close the valve 32 when needed. Alternatively, the valve can be operated by a control line, hydraulic or electric that runs to it from the surface 12. Other modes of sending a signal from the surface 12 to the valve 32 to close when needed are also contemplated, such as acoustic or light signals on a fiber optic cable, for example. In the preferred embodiment, the operation of valve 32 is automatic to prevent overpressure of lower rated equipment uphole without having to have surface personnel observe the condition and then react, when it might be too late. Valve 32 can have a restricted flow path so that fluid velocity at a certain speed can result in a net force on the sleeve that surrounds the orifice to create a net force on the valve member 32 to resettably move valve 32 against a force that had earlier held it open such as schematically illustrated by arrow 31 which can be a spring or to move valve 32 a single time by a friction force or a retaining pin acting on valve 32 to keep it from moving until a predetermined force is applied from fluid velocity. Surface personnel will see a drop in annulus pressure as well as a rapid rise in workstring 10 pressure to know that a sand out has occurred and that pumping should cease before any damage to the uphole equipment from overpressure.

The above description is illustrative of the preferred embodiment and many modifications may be made by those skilled in the art without departing from the invention whose scope is to be determined from the literal and equivalent scope of the claims below.

I claim:

1. A method for treating a formation downhole, comprising:

isolating the formation around a workstring with a packer disposed in an annular space between the workstring and wellbore casing, wherein said annular space is separated into an upper annular space and a lower annular space by said packer;

providing a return path from the formation through said packer from said lower annular space to said upper annular space surrounding the workstring;

pumping fluid from the surface through said workstring and returning said fluid through said return path and to the surface;

selectively closing the return path using a valve in said lower annular space while pumping said fluid, where in said valve is actuated by a pressure buildup within the lower annular space or an increase in velocity of said fluid moving through said lower annular space and away from said isolated formation.

2. The method of claim 1, comprising:

fracturing the formation through the workstring.

3. The method of claim 1, comprising:

running the workstring through a seal point in a surrounding tubular.

4. The method of claim 3, comprising:

creating pressure buildup by fracturing the formation.

5. The method of claim 3, comprising:

making said valve respond automatically to pressure buildup.

6. The method of claim 5, comprising:

providing a pressure differential responsive sleeve to selectively close said return path.

7. The method of claim 3, comprising:

operating said valve from the surface.

8. The method of claim 3, comprising:

using a signal from the surface to operate said valve;

using at least one of pressure, electricity, light or sound as said signal.

9. The method of claim 3, comprising:

making said seal point a packer or a seal bore.

10. The method of claim 1, comprising:

protecting equipment uphole from the formation and in communication with said lower annular space by said closing.

11. The method of claim 1, comprising:

running said work string through a seal bore in a surrounding tubular;

seating said workstring in said seal bore.

12. The method of claim 11, comprising:

running said return path through said seal bore and outside said work string.

* * * * *